United States Patent [19]

Adams et al.

[11] Patent Number: 4,841,496

[45] Date of Patent: Jun. 20, 1989

[54] APPLIANCE TIMER

[75] Inventors: George W. Adams, Greenwood; Steven W. Smock; Ross G. Helft, both of Indianapolis, all of Ind.

[73] Assignee: Emhart Industries, Inc., Indianapolis, Ind.

[21] Appl. No.: 134,166

[22] Filed: Dec. 17, 1987

[51] Int. Cl.[4] ..... G04F 8/00;•H01H 43/10

[52] U.S. Cl. ..... 368/107; 200/38 B; 200/246; 200/262; 338/202; 338/330

[58] Field of Search ..... 368/107–113; 307/141, 141.4; 338/99, 202, 223–225, 322, 327, 328, 330; 200/38 R, 38 B, 265, 246, 262

[56] References Cited

U.S. PATENT DOCUMENTS

| | | | |
|---|---|---|---|
| 3,918,020 | 11/1975 | Durocher | 338/114 |
| 3,938,070 | 2/1976 | Koerner et al. | 338/60 |
| 4,079,269 | 3/1978 | Numata et al. | 307/247 R |
| 4,180,715 | 12/1979 | Lichtenberger | 200/2467 |
| 4,355,217 | 10/1982 | Cushing | 200/38 R |
| 4,575,594 | 3/1986 | Amonett | 200/38 B |
| 4,734,548 | 3/1988 | Cole | 200/38 R |

*Primary Examiner*—Vit W. Miska

*Attorney, Agent, or Firm*—Carl A. Forest

[57] ABSTRACT

An appliance timer includes a motor driven cam carried in a housing. A switch blade carried in the housing is responsive to the cam to selectively activate one of a pair of switch circuits, each of which provide a different operating level for an appliance function, e.g. several different heat levels in an automatic dryer. Each switch circuit includes a contact, a contact support spring, and an electrical feed-through which connects to a terminal strap on the exterior of the housing. A resistor that is an integral part of one of the switch circuits provides the level differentiation between the circuits. In one embodiment a carbonaceous organic resistor chip replaces the circuit contact. In another embodiment an inorganic ceramic resistor slug replaces the circuit feed-through.

14 Claims, 3 Drawing Sheets

APPLIANCE TIMER

BACKGROUND OF THE INVENTION

1. Field of the invention

The present invention relates to electromechanical timers used in controlling appliance functions in which the level of a function is selectable, such as the high, medium and low heat levels in an automatic dryer, and more particularly to such a timer in which the resistor or capacitor that provides differentiation between level settings forms an integral part of the switch circuit structure.

2. Description of the Prior Art

Electromechanical timers are widely used to control functions in automatic appliances. Such timers utilize a cam driven by a motor to activate switches which control appliance functions. Generally the cam and at least the switch blade portion of the switch structure are enclosed in a housing. The motor is generally mounted in a sub-housing and drives the cam through a gear train. The switch structure generally comprises one or more switch blades that are movable by the cam, one or more contacts mounted on the blade, one or more contact supports and contacts mounted on the supports, switch terminals mounted exteriorly of the housing, feed-throughs which connect the contact supports and blades inside the housing to the terminals outside the housing, and terminal straps which may connect terminals or terminals and feed-throughs.

Often a timer is required to control not only the timing of appliance function, but also the level of the function. For example, the high, medium, and low heat levels of conventional automatic clothes dryers are selected by setting the dryer timer to either a high, medium or low drying "cycle". In prior art timers, such different function levels are implemented by providing a plurality of electrical circuit paths, one or more of which is selected by setting the timer "cycle" which activates a switch to connect one or more of the circuits. The circuits differ in resistance and/or capacitance to provide the different function levels. In the prior art timers, the particular function levels are determined by the appliance manufacturer by soldering or otherwise connecting the leads of a conventional axially leaded capacitor or resistor to female terminals which terminals are connected to male timer terminals exterior of the timer housing. Often it is found to be necessary to place insulation over the resistor and/or capacitor leads to prevent shorting.

SUMMARY OF THE INVENTION

It is an object of the invention to provide an appliance timer that overcomes one or more disadvantages of the prior art appliance timers.

It is another object of the invention to provide an appliance timer that does not have large resistors or capacitors attached on the exterior of the housing.

It is a further object of the invention to provide an appliance timer that is more compact than prior art timers.

It is still another object of the invention to provide a timer that employs lower wattage rated resistors and capacitors than prior art appliance timers.

The invention provides an appliance timer having a housing, a motor driven cam programming means carried in the housing, a switch blade responsive to the cam programming means, and a plurality of electrical switch circuit means for providing a plurality of operating levels for a function of the appliance, each switch circuit means comprising one or more of the following switch circuit components: the switch blade, a first contact mounted on the switch blade, second contact means for cooperating with the first contact means, support means for supporting the second contact means, a terminal mounted exteriorly of the housing, a housing feed-through, and a terminal strap, the improvement comprising a leadless resistor or capacitor electrically and mechanically attached directly to at least one of the switch circuit components, the resistor or capacitor having a predetermined resistance or capacitance whereby it provides differentiation between the plurality of circuits to provide the plurality of operating levels. Preferably the leadless resistor or capacitor comprises a carbonaceous organic chip resistor or, alternatively, an inorganic ceramic resistor. Preferably the leadless resistor or capacitor is mounted on the support means and comprises the second contact means. In an alternative embodiment, the second contact support means is carried within the housing, the housing includes an opening therein adjacent the second contact support means, the terminal strap is mounted externally of the housing and has a portion adjacent the opening, and the leadless capacitor or resistor extends through the opening and abuts the second contact support means and the terminal strap. Preferably the opening in the housing comprises a cylindrical bore, the leadless element comprises a cylinder, and the second contact means and the terminal strap abut the opposing ends of the cylinder.

The appliance timer according to the invention not only is more compact because the level differentiating resistor or capacitor is an integral part of the switch circuit structure, but also, since it is directly connected to one of the switch circuit components, the component will act as a heat sink, thereby permitting even smaller resistors to be used. It is also been found that the invention eliminates the miswiring that tended to occur with the level differentiating resistors or capacitors of prior art timers. Numerous other features, objects, and advantages of the invention will become apparent from the following detailed description when read in conjunction with the accompanying drawings.

DESCRIPTION OF THE PREFERRED EMBODIMENT

Figure 1:
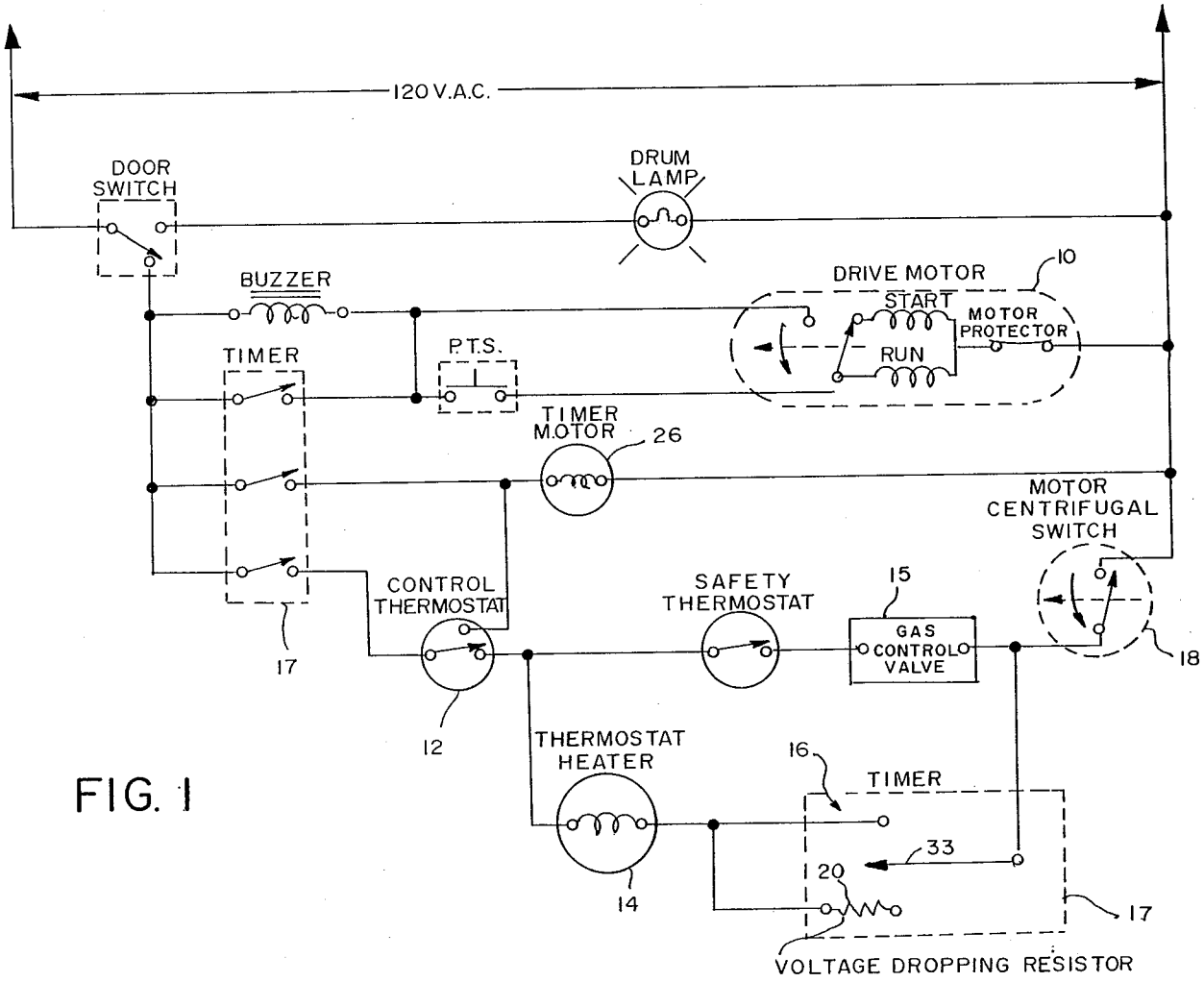
FIG. 1 is a block circuit diagram showing the connection of a timer according to the invention within the circuitry of a conventional automatic clothes dryer, a typical appliance in which the invention may be used.

The particular invention to be disclosed is more easily understood when its use is understood, and therefore we shall begin by first describing a typical use. Directing attention to FIG. 1, a block circuit diagram of a preferred embodiment of the invention within the circuit of a conventional automatic clothes dryer is shown. It is to be understood that the use in a dryer and the embodiments of the inventions disclosed are exemplary and are not intended to be limiting of the invention. The conventional dryer shown is operated by placing wet clothes in an airtight drum that is made to rotate about a horizontal plane by motor 10. The speed of the drum is sufficient to lift the clothes ¾ the way up the side, and then the clothes fall back to the bottom. A heating device and a blower are used to pull room air into the dryer and heat it. This heated air is forced through the tumbling clothes and out the exhaust stack. A thermostat 12 is installed in the exhaust stack that senses the temperature of the exhaust air leaving the drum. The thermostat 12 turns off the heater via gas control valve 15 when the exhaust air temperature reaches a certain pre-determined temperature. Generally this will be a relatively low temperature for delicate fabrics, a medium temperature for permanent-press fabrics, and a relatively high temperature for normal fabrics. While it would be possible to use three different thermostats for the three heating levels, the preferred method of obtaining the three levels is to use a single thermostat 12 and a small heater 14 placed around the body of the thermostat. The thermostat heater 14 is connected in series with a switch 16 in timer 17 and the two are connected into the dryer circuit between the motor centrifugal switch 18 and the control thermostat 12. To obtain a high temperature level, the timer switch 16 is placed in the open position as shown in FIG. 1. To obtain a low temperature level, the switch 16 is placed in the upper portion which turns on the thermostat heater 14. To obtain a medium heat level, the switch 16 is placed in the lower position which again turns on the thermostat heater, but also places a voltage-dropping resistor 20 in series with the heater. This resistor 20 is the level-differentiating resistor that is the principal focus of the present invention. Since the current is A.C., a capacitor may also be used as the voltage dropping electrical component, although for the embodiment shown, a resistor has been found to be preferable.

Figure 2:
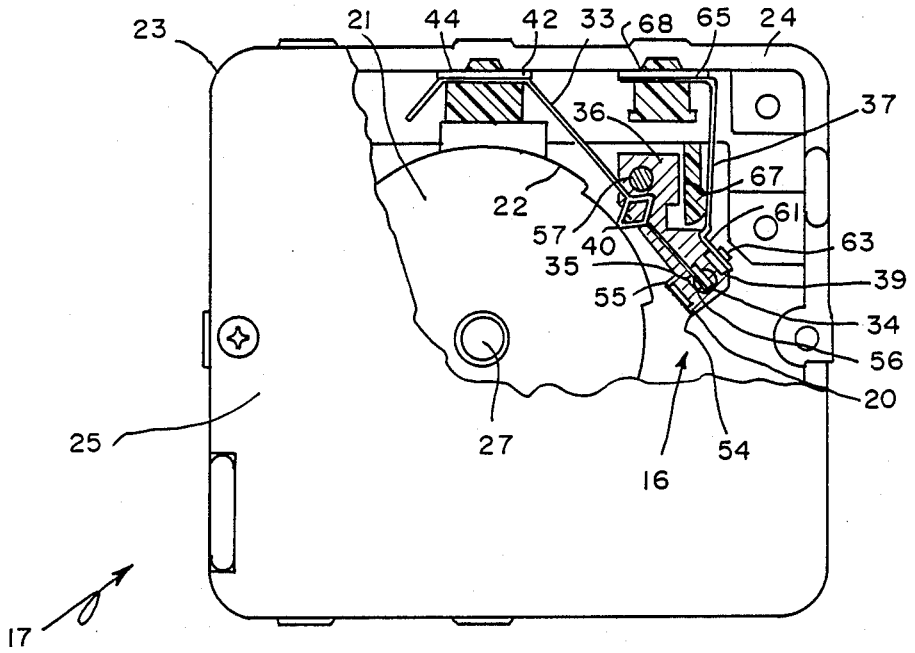
FIG. 2 shows a front view of a preferred embodiment of a timer according to the invention, with the front cover partially cut away to show the internal components relating to the invention.
Figure 3:
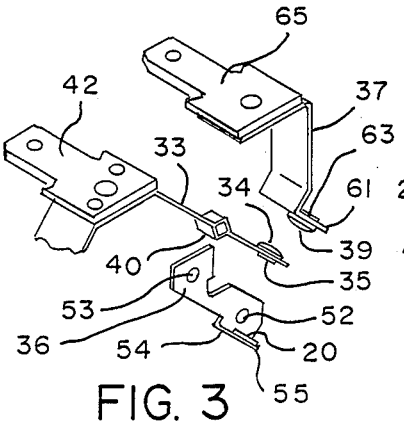
FIG. 3 is an exploded perspective view of the switch blade, contact supports, and contacts of the timer of FIG. 2.
Figure 4:
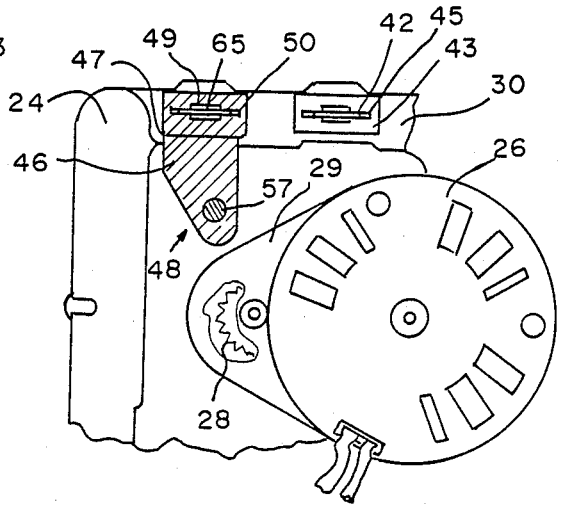
FIG. 4 is a plane partially cut away view of the back of the timer of FIG. 2.
Figure 5:
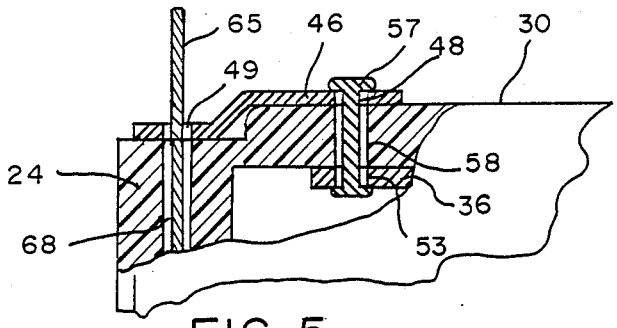
FIG. 5 is a partial cross-sectional side view of a portion of the timer of FIG.2.

Turning now to FIGS. 2, 3, 4 and 5, a timer 17 according to a preferred embodiment of the invention is shown. FIG. 2 shows a front view with the upper-right-hand corner of the timer cover 25 partially cut away to reveal the internal components relating to the invention. FIG. 4 shows a back view, while FIG. 5 shows a side view. FIG. 3 shows the switch 16 mechanism in exploded perspective. The timer 17 includes a cam programming means 21 and switch 16 enclosed in a housing 23. The housing 23 includes a box-or-cup-shaped portion 24 and a cover 25. Cam programming means 21 has cam lobes 22 that engage switch 16. Cam means 21 is driven by a motor 26 via cam shaft 27 and gears 28. Motor 26 and gears 28 are enclosed in a sub-housing 29 mounted on the back 30 of housing 23. Switch 16 includes a movable blade 33, having contacts 34 and 35, and contact supports 36 and 37 which support contacts 20 and 39 respectively, contact 20 being a chip resistor. Contact support 36 is generally referred to as a "bottom spring" while contact support 37 is generally referred to as a "top spring". The timer operates by motor 26 driving switch blade 33 through a programmed cycle determined by the speed of the motor, the gearing, and the shape of cam lobes 22.

Movable switch blade 33 comprises a flexible conductive blade lanced to form opposing V-shaped leads, one of which forms projection 40 which rides on lobes 22. In the preferred embodiment, blade 33 is one side of a double spring blade which is bent in the middle and attached to a combination feed-through and terminal member 42 by semi-perf staking: i.e., one or more extrusions are formed on the feed-through 42 and holes are punched in the blade 33, the blade holes are placed over the extrusions and the extrusions are flattened in a press to form the connection. The blade-feed-through terminal combination is pressed into a slot 44 in the housing structure, while the feed-through-terminal slips through a slot extension in the housing body and extending out the back 30 of the housing. A staking washer 43 is placed over the end of terminal 42 and the terminal is staked with knives to flare out stakes 45 to hold the washer 43, terminal-feed-through 42, and the blade 33 in place.

Bottom spring 36 is a shaped metal piece having holes 52, and 53 at either end and a bent up flange 54. In the preferred embodiment, a chip resistor 20 is attached to flange 54 with epoxy 55 and serves as the contact. Top spring 37 is a formed conductive strip having a flange 61 with a hole through it. Contact 39 is disk-shaped with a cylindrical stem 63. Stem 63 is inserted through the hole in flange 61 and flattened to hold contact 39 to top spring 37. The other end of the top spring is attached to a feed-through-terminal combination 65 by semi-perf staking. Terminal strap 46 (FIG. 4) is a roughly holster-shaped piece of metal, bent at 47 to conform to the shape of housing body 24 and having a hole 48 at the narrow end of the holster and a slot 49 at the other. The bottom spring 36, top spring 37 and terminal strap 46 are connected together and to the housing body 24 as follows: Hole 52 in bottom spring 36 is placed over a stud 56 molded into housing body 24 and a rivet 57 is placed through hole 53 in bottom spring 36, hole 58 in housing body 24, and hole 48 in terminal strap 46 and the ends flattened to hold the bottom spring 36 and the narrower part of terminal strap 46 in place. Top spring 37 and feed-through-terminal 65 are pressed into a slot 68 in housing body 24, with the feed-through-terminal 65 passing through an extension of the slot and extending out the back 30 of the housing, and through slot 49 in terminal strap 46. The terminal 65 is then staked with knives to flare out stakes 50 to hold the feed-through-terminal combination 65, the terminal strap 46, and the top spring 37 in place. Post 67 formed in housing 24 positions the free end of top spring 37 (FIG. 2).

Figure 6:
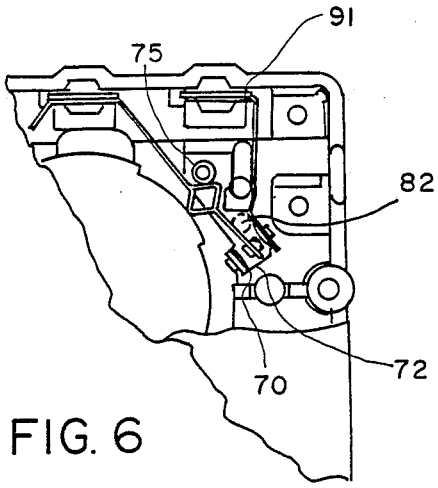
FIG. 6 is a front view of a portion of an alternative preferred embodiment of a timer according to the invention, with the cover partially cut away.
Figure 8:
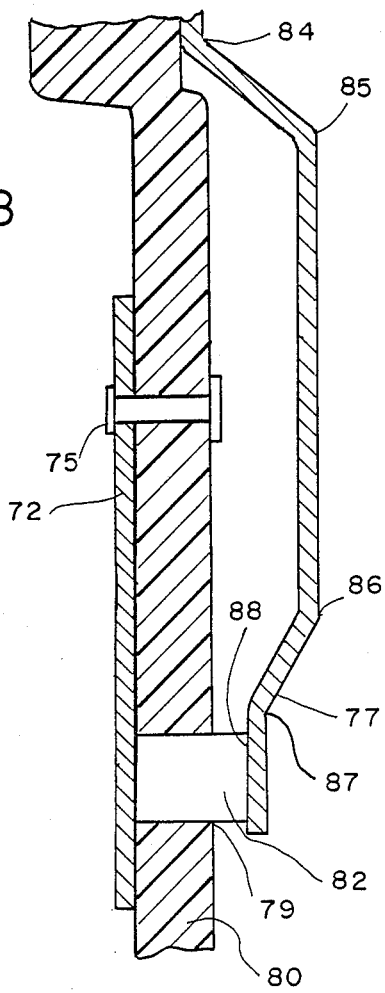
FIG. 8 is an expanded cross-sectional view of a portion of the timer of FIG. 6 showing the resistor abutting the switch support and the terminal strap.
Figure 7:
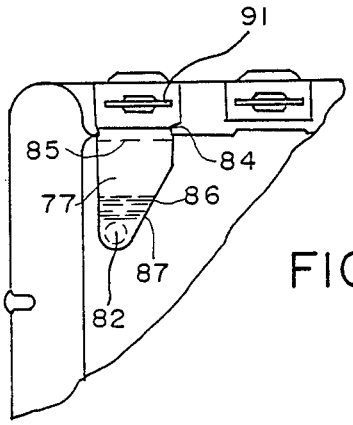
FIG. 7 is a rear view of the timer portion shown in FIG. 6.

Another preferred embodiment of the invention is shown in FIGS. 6, 7 and 8. This embodiment is similar to the embodiment of FIGS. 2–5 with the following differences. Resistor contact 20 of the above embodiment is replaced by a contact 70 that is similar to contact 39 in top spring 37 and attached to bottom spring 72 in the same manner as contact 39 is attached to the top spring. Rivet 75 is crimped in place, against the housing 80, rather than placing the rivet through the terminal strap 77. A cylindrical hole 79 is formed in housing wall 80 adjacent to bottom spring 72 and a cylindrical inorganic slug resistor 82 is inserted in the hole. Terminal strap 77 is lengthened, the "holster" slant reversed, and it is bent at 84, 85, 86 and 87 so that it clears rivet 75 and presses firmly against end 88 of cylindrical slug 82.

In the preferred embodiment, housings 23 and 80 are compression molded out of Bakelite TM plastic. Switch blade 33 and top spring 37 are formed of Olin TM 194 copper alloy, bottom springs 36 and 72, feed-through terminals 42, 91 and 65 and terminal straps 46 and 77 are C.D.A. 260 pre-tinned brass; contacts 34, 35, 39 and 70 are made of silver cadmium oxide. Resistor 20 is a molded carbonaceous organic resistor and 82 is an inorganic ceramic resistor, both with sprayed brass contacts and both available from Stackpole Electric Company, St. Mary's, Pa.

In the preferred embodiment resistors 20 and 82 are 6800 ohms. Epoxy 55 is preferably type 16-1 available from Ablestick Labs of Gardena, Calif. Other parts and materials are conventional.

It is a feature of the invention that the differentiating resistor 20, 82 is an integral part of the timer structure. In the embodiment of FIG. 2 it serves as the contact of switch 16, while in the embodiment of FIG. 6 it serves as the feed-through between switch bottom spring 72 and terminal strap 77. Thus in each embodiment two parts of the prior art timer is replaced by a single part. This results in the elimination of three or more manufacturing steps—the soldering of male terminals to each of two leads on the resistor, the attaching of the male terminals to the female timer terminals and possibly the covering of the leads with insulation—with resulting economics of materials and labor.

It is another feature of the invention that the resistor 20, 82 directly contacts a part of the timer structure that acts as a natural heat sink. By "directly contacts" herein is meant that it contacts the part without intervening wire leads. This direct contact permits the heat generated by the resistor to easily flow into the adjoining parts that it contacts. Since the resistor's function in the circuit is one in which it tends to generate significant heat, this feature is highly advantageous. In the prior art, large resistors with high wattage ratings were required for this function. With the heat sink feature, smaller resistors with a lower wattage rating can be used. This permits the timer to be even more compact.

Another feature of the invention is that it eliminates a problem source that has long plagued the industry. A timer by its nature has many terminals protruding from the back 30. These terminals all appear similar, and in the prior art method of adding a level differentiating resistor, the resistor sometimes was attached to the wrong terminals. With the design of the invention, the placement of the resistor is more certain.

Another advantage of the invention is that the integral nature of the resistor allows it to be installed in the natural flow of assembly of the timer rather than being added on in a separate step after assembly. Such assembly is generally carried out on an assembly line and includes an automatic test of the assembled timer as the last step on the line. With the invention, it is much easier to integrate an automatic test of the ohmic or capacitive value of the level differentiating resistor or capacitor into the manufacturing process. This results in a further gain in economy and quality.

A novel timer having an integral level differentiating resistor or capacitor providing many advantages has been described. It is evident that those skilled in the art may now make many uses and modifications of the specific embodiment described without departing from the inventive concepts. For example, the invention can be applied in any timer in which an exterior resistor is added for voltage dropping purposes. The resistor can also be attached to other parts of the timer switch circuit structure and by any method which permits the heat sink function to take place, such as staking, soldering, clinching, etc. Other types of resistor materials can be employed. Consequently, the invention is to be construed as embracing each and every novel feature and novel combination of features present in the timer described.

What is claimed is:

1. In an appliance timer having a housing, a motor driven cam programming means carried in said housing, a switch blade responsive to said cam programming means, and a plurality of electrical switch circuit means for providing a plurality of operating levels for a function of said appliance, each switch circuit means comprising one or more of the following switch circuit components: said switch blade, a first contact mounted on said switch blade, second contact means for cooperating with said first contact means, support means for supporting said second contact means, a terminal mounted exteriorly of said housing, a housing feed-through, and a terminal strap, the improvement comprising a leadless resistor or capacitor electrically and mechanically attached directly to at least one of said switch circuit components, said resistor or capacitor having a predetermined resistance or capacitance whereby it provides differentiation between said plurality of circuits means to provide said plurality of operating levels.

2. An appliance timer as in claim 1 wherein said leadless resistor or capacitor comprises a carbonaceous organic chip resistor.

3. An appliance timer as in claim 1 wherein said leadless resistor or capacitor comprises an inorganic ceramic resistor.

4. An appliance timer as in claim 1 wherein said leadless resistor or capacitor is mounted on said support means and comprises said second contact means.

5. An appliance timer as in claim 4 wherein said leadless resistor or capacitor comprises a chip resistor.

6. An appliance timer as in claim 1 wherein said second contact support means is carried within said housing, said housing includes an opening therein adjacent said second contact support means, said terminal strap is mounted externally of said housing and has a portion adjacent said opening, and said leadless capacitor or resistor extends through said opening and abuts said second contact support means and said terminal strap.

7. An appliance timer as in claim 6 wherein said opening in said housing comprises a cylindrical bore, said leadless element comprises a cylinder, and said second contact means and said terminal strap abut the opposing ends of said cylinder.

8. An appliance timer as in claim 7 wherein said leadless resistor or capacitor is an inorganic plastic resistor.

9. An appliance timer comprising:

a housing;

a motor driven cam programming means carried in said housing;

a switch blade responsive to said cam programming means; and at least one electrical switch circuit means including one or more of the following components: first contact means mounted on said switch blade; second contact means for cooperating with said first contact means; support means for supporting said second contact means; a terminal mounted exteriorly of said housing; and a housing feed-through;

wherein at least one of said electrical switch circuit components comprises a chip resistor or chip capacitor.

10. An appliance timer as in claim 9 wherein said electrical circuit component which comprises said chip resistor or chip capacitor is said second contact means.

11. An appliance timer as in claim 9 wherein said chip resistor is a carbonaceous organic resistor.

12. An appliance timer comprising:

a housing;

a motor driven cam programming means carried in said housing;

a switch blade responsive to said cam programming means; and at least one electrical switch circuit means including one or more of the following components: first contact means mounted on said switch blade; second contact means for cooperating with said first contact means; support means for supporting said second contact means; a terminal mounted exteriorly of said housing; and a housing feed-through;

wherein at least one of said electrical switch circuit components comprises a resistor slug.

13. An appliance timer as in claim 12 wherein said electrical circuit component that comprises said slug resistor is said feed-through.

14. An appliance timer as in claim 12 wherein said resistor comprises an inorganic ceramic resistor.

* * * * *